US010246945B2

(12) United States Patent
Boehm et al.

(10) Patent No.: US 10,246,945 B2
(45) Date of Patent: Apr. 2, 2019

(54) EARTH-BORING TOOLS, METHODS OF FORMING EARTH-BORING TOOLS, AND METHODS OF FORMING A BOREHOLE IN A SUBTERRANEAN FORMATION

(71) Applicant: Baker Hughes, a GE company, LLC, Houston, TX (US)

(72) Inventors: Alexander Boehm, Wheat Ridge, CO (US); Nephi M. Mourik, Highlands Ranch, CO (US); Timothy P. Uno, Spring, TX (US); Miguel E. Garcia, Houston, TX (US)

(73) Assignee: Baker Hughes Incorporated, a GE Company, LLC, Houston, TX (US)

( * ) Notice: Subject to any disclaimer, the term of this patent is extended or adjusted under 35 U.S.C. 154(b) by 209 days.

(21) Appl. No.: 14/813,502

(22) Filed: Jul. 30, 2015

(65) Prior Publication Data

US 2016/0032655 A1 Feb. 4, 2016

Related U.S. Application Data

(60) Provisional application No. 62/030,894, filed on Jul. 30, 2014.

(51) Int. Cl.
*E21B 10/55* (2006.01)
*E21B 10/43* (2006.01)

(52) U.S. Cl.
CPC ..... *E21B 10/55* (2013.01); *E21B 10/43* (2013.01)

(58) Field of Classification Search
CPC ..... E21B 10/42; E21B 10/43
See application file for complete search history.

(56) References Cited

U.S. PATENT DOCUMENTS

| | | | |
|---|---|---|---|
| 6,575,256 | B1 | 6/2003 | Doster |
| 6,695,073 | B2 | 2/2004 | Glass et al. |
| 8,127,869 | B2 | 3/2012 | Vempati et al. |
| 8,316,967 | B2 | 11/2012 | Gavia |
| 8,505,634 | B2 | 8/2013 | Lyons et al. |
| 2005/0096847 | A1 | 5/2005 | Huang |
| 2005/0269139 | A1 | 12/2005 | Shen et al. |
| 2008/0179106 | A1 | 7/2008 | Gavia et al. |
| 2008/0302573 | A1 | 12/2008 | Sinor et al. |
| 2010/0147594 | A1 | 6/2010 | Ben Lamin et al. |

(Continued)

OTHER PUBLICATIONS

Chen et al., A New Theory on Cutter Layout for Improving PDC-Bit Performance in Hard-and Transit-Formation Drilling, SPE Drilling and Completion, Dec. 2013, pp. 338-349.

(Continued)

*Primary Examiner* — Giovanna C. Wright
*Assistant Examiner* — Jonathan Malikasim
(74) *Attorney, Agent, or Firm* — TraskBritt

(57) ABSTRACT

An earth-boring tool comprises a body having a face at a leading end thereof, blades extending from the body and comprising primary blades and secondary blades, and cutting elements on the blades and arranged in groups each comprising neighboring cutting elements. Some of the groups are disposed only on the primary blades in a first spiral configuration. Others of the groups disposed only on the secondary blades in a second, opposing spiral configuration. Methods of forming an earth-boring tool, and methods of forming a borehole in a subterranean formation are also described.

19 Claims, 7 Drawing Sheets

(56) References Cited

U.S. PATENT DOCUMENTS

| | | | | |
|---|---|---|---|---|
| 2011/0000714 | A1* | 1/2011 | Durairajan | E21B 10/55 175/57 |
| 2011/0155472 | A1* | 6/2011 | Lyons | E21B 10/55 175/331 |
| 2011/0240376 | A1* | 10/2011 | Chen | E21B 10/43 175/336 |
| 2012/0152623 | A1 | 6/2012 | Chen | |
| 2012/0234610 | A1 | 9/2012 | Azar et al. | |
| 2014/0124270 | A1* | 5/2014 | Durairajan | E21B 10/43 175/336 |

OTHER PUBLICATIONS

Halliburton, MegaForce, Drill Bit, Drill Bits & Services, www.halliburton.com, 2012, 2 pages.
International Search Report from PCT International Application No. PCT/US2015/042840, dated Oct. 21, 2015, 5 pages.
International Written Opinion from PCT International Application No. PCT/US2015/042840, dated Oct. 21, 2015, 10 pages.

* cited by examiner

EARTH-BORING TOOLS, METHODS OF FORMING EARTH-BORING TOOLS, AND METHODS OF FORMING A BOREHOLE IN A SUBTERRANEAN FORMATION

CROSS-REFERENCE TO RELATED APPLICATION

This application claims the benefit of U.S. Provisional Patent Application Ser. No. 62/030,894, filed Jul. 30, 2014, the disclosure of which is hereby incorporated herein in its entirety by this reference.

TECHNICAL FIELD

The disclosure relates generally to earth-boring tools, to methods of forming earth-boring tools, and to methods of forming a borehole in a subterranean formation. More particularly, embodiments of the disclosure relate to earth-boring tools exhibiting favorable force distribution, damage distribution, and stability characteristics during drilling operations, and to methods of forming and using such earth-boring tools.

BACKGROUND

Earth-boring tools employing cutting elements such as polycrystalline diamond compact (PDC) cutters have been employed for several decades. PDC cutters are conventionally comprised of a disc-shaped diamond table formed on and bonded (under ultra-high pressure, ultra-high temperature conditions) to a supporting substrate such as a substrate comprising cemented tungsten carbide, although other configurations are generally known in the art. Rotary drill bits carrying PDC cutters, also known as so-called "fixed-cutter" drag bits, have proven very effective in achieving high rates of penetration (ROP) in drilling subterranean formations exhibiting low to medium hardness.

PDC cutters are typically laid out on a rotary drill bit either in a reverse spiral configuration that follows the rotational direction of the rotary drill bit or in a forward spiral configuration that opposes the rotational direction of the rotary drill bit, with PDC cutters having the most similar loading positioned proximate one another. However, such configurations can produce problems during use and operation of the rotary drill bit, such as an uneven distribution of forces on the rotary drill bit during drilling operations, resulting in rotary drill bit instability and vibration, an uneven damage (e.g., dulling) distribution to the PDC cutters, and a reduced operational life of the rotary drill bit. For example, during drilling operations closely grouped leading PDC cutters of a reverse spiral configuration may endure the greatest forces (e.g., during initial contact with subterranean formation material, during transitions between relatively softer subterranean formation material and a relatively harder subterranean formation material, etc.), resulting in force imbalances across the rotary drill bit (and, hence, rotary drill bit instability and vibrations) as well as progressively greater amounts of damage to trailing PDC cutters of the reverse spiral configuration.

Accordingly, it would be desirable to have earth-boring tools (e.g., rotary drill bits), methods of forming earth-boring tools, and methods of forming a borehole in a subterranean formation facilitating enhanced stability, improved damage distribution, and prolonged operational life during drilling operations as compared to conventional earth-boring tools, methods of forming earth-boring tools, and methods of forming a borehole in a subterranean formation.

BRIEF SUMMARY

In some embodiments, an earth-boring tool comprises a body having a face at a leading end thereof, blades extending from the body and comprising primary blades and secondary blades, and cutting elements on the blades and arranged in groups each comprising neighboring cutting elements. Some of the groups are disposed only on the primary blades in a first spiral configuration. Others of the groups are disposed only on the secondary blades in a second, opposing spiral configuration.

In additional embodiments, a method of forming an earth-boring tool comprises forming a body comprising a face at a leading end thereof, blades extending from the body and comprising primary blades and secondary blades. Cutting elements are disposed on the blades in groups each comprising neighboring cutting elements, some of the groups disposed only on the primary blades in a first spiral configuration, others of the groups disposed only on the secondary blades in a second, opposing spiral configuration.

In further embodiments, a method of forming a borehole in a subterranean formation comprises disposing an earth-boring tool at a distal end of a drill string in a borehole in a subterranean formation, the earth-boring tool comprising a body having a face at a leading end thereof, blades extending from the body and comprising primary blades and secondary blades, and cutting elements on the blades and arranged in groups each comprising neighboring cutting elements, some of the groups disposed only on the primary blades in a first spiral configuration, others of the groups disposed only on the secondary blades in a second, opposing spiral configuration. Weight-on-bit is applied to the earth-boring tool through the drill string to contact the subterranean formation while rotating the earth-boring tool. The subterranean formation is engaged with the cutting elements of the rotating earth-boring tool.

DETAILED DESCRIPTION

Figure 1:
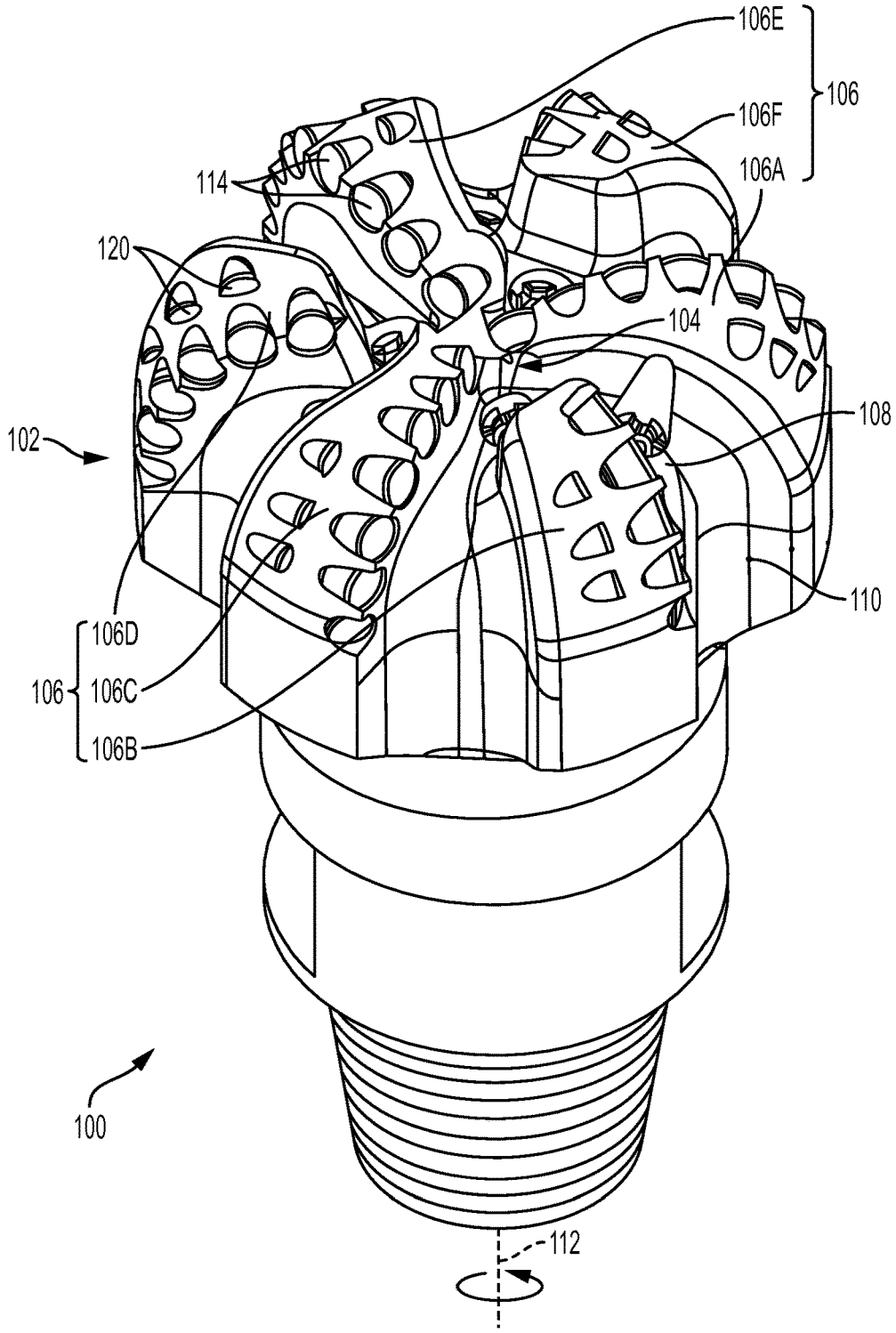
FIG. 1 is a perspective view of a rotary drill bit, in accordance with an embodiment of the disclosure.

Earth-boring tools are disclosed, as are methods of forming earth-boring tools, and methods of forming a borehole in a subterranean formation. In some embodiments, an earth-boring tool includes a body including a face, a plurality of primary blades, and a plurality of secondary blades. Cutting elements are distributed on the primary blades and the secondary blades in groups each including a plurality of neighboring cutting elements. Some of the groups may be disposed only on the primary blades. Others of the groups may be disposed only on the secondary blades. The groups disposed only on the primary blades may extend in a first direction relative to the rotational direction of the earth-boring tool, and the groups disposed only on the secondary blades may extend in a second direction opposite the first direction. The layout of the cutting elements on the earth-boring tool may more evenly distribute forces, may more evenly distribute damage, may reduce instabilities, and may increase operational life during drilling operations as compared to conventional earth-boring tools and methods.

In the following detailed description, reference is made to the accompanying drawings that depict, by way of illustration, specific embodiments in which the disclosure may be practiced. However, other embodiments may be utilized, and structural, logical, and configurational changes may be made without departing from the scope of the disclosure. The illustrations presented herein are not meant to be actual views of any particular component, apparatus, assembly, system, or method, but are merely idealized representations that are employed to describe embodiments of the present disclosure. The drawings presented herein are not necessarily drawn to scale. Additionally, elements common between drawings may retain the same numerical designation.

As used herein, the term "earth-boring tool" means and includes bits, core bits, reamers, and so-called hybrid bits, each of which employs a plurality of fixed cutting elements to drill a borehole, enlarge a borehole, or both drill and enlarge a borehole.

As used herein, the singular forms "a," "an," and "the" are intended to include the plural forms as well, unless the context clearly indicates otherwise.

As used herein, relational terms, such as "first," "second," "top," "bottom," "upper," "lower," "over," "under," etc., are used for clarity and convenience in understanding the disclosure and accompanying drawings and do not connote or depend on any specific preference, orientation, or order, except where the context clearly indicates otherwise.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

FIG. 1 is a perspective view of a rotary drill bit 100 in the form of a fixed cutter or so-called "drag" bit, according to an embodiment of the disclosure. The rotary drill bit 100 includes a body 102 exhibiting a face 104 defined by external surfaces of the body 102 that contact a subterranean formation during drilling operations. The body 102 may comprise, by way of example and not limitation, an infiltrated tungsten carbide body, a steel body, or a sintered particle matrix body, and may include a plurality of blades 106 exhibiting a spiraling configuration relative to a rotational axis 112 of the rotary drill bit 100. The blades 106 may receive and hold cutting elements 114 within pockets, and may define fluid courses 108 therebetween extending into junk slots 110 between gage sections of circumferentially adjacent blades 106. In some embodiments, the body 102 includes an even number of the blades 106, such as greater than or equal to four of the blades 106 (e.g., four of the blades 106, six of the blades 106, eight of the blades 106, etc.). For example, as depicted in FIG. 1, the body 102 may include six (6) of the blades 106. In additional embodiments, the body 102 includes a different quantity (e.g., number, amount, etc.) of the blades 106. The body 102 may include, for example, an odd number of the blades 106 (e.g., five of the blades 106; seven of the blades 106; etc.). Non-limiting examples of such different blade configurations are described in further detail below. Accordingly, while various embodiments herein describe or illustrate the body 102 as including the six (6) blades 106A-106F, the body 102 may, alternatively, include a different number of the blades 106.

As shown in FIG. 1, the blades 106 may include primary blades 106A, 106C, 106E, and secondary blades 106B, 106D, 106F. At least a portion (e.g., each) of the primary blades 106A, 106C, 106E may be circumferentially separated from one another by the secondary blades 106B, 106D, 106F, and may each include a first end located radially proximate the rotational axis 112 of the rotary drill bit 100. In addition, at least a portion (e.g., each) of the secondary blades 106B, 106D, 106F may be circumferentially separated from one another by the primary blades 106A, 106C, 106E, and may each include a first end located more radially distal from the rotational axis 112 of the rotary drill bit 100 than the first end of each of the primary blades 106A, 106C, 106E. As shown in FIG. 1, the primary blades 106A, 106C, 106E may circumferentially alternate with the secondary blades 106B, 106D, 106F around the face 104 of the rotary drill bit 100. A first primary blade 106A may be circumferentially separated from a second primary blade 106C by a first secondary blade 106B, the second primary blade 106C may be circumferentially separated from a third primary blade 106E by a second secondary blade 106D, and the third primary blade 106E may be circumferentially separated from the first primary blade 106A by a third secondary blade 106F. In additional embodiments, such as in embodiments wherein the body 102 exhibits a different number of the blades 106, the body 102 may exhibit a different quantity and/or a different circumferential sequence (e.g., circumferential pattern) of primary blades and secondary blades. The body 102 may include, for example, an even number of primary blades circumferentially alternating with an even number of secondary blades (e.g., two primary blades circumferentially alternating with two secondary blades, four primary blades circumferentially alternating with four secondary blades, etc.), an odd number of primary blades at least partially circumferentially alternating with an even number of secondary blades (e.g., three primary blades circumferentially alternating with two secondary blades, three primary blades partially circumferentially alternating with four secondary blades, etc.), or an even number of primary blades at least partially circumferentially alternating with an odd number of secondary blades (e.g., two primary blades circumferentially alternating with three secondary blades, four primary blades partially circumferentially alternating with three secondary blades, etc.). Non-limiting examples of such different configurations (e.g., quantities, sequences, etc.) of primary blades and secondary blades are described in further detail below. Accordingly, while various embodiments herein describe or illustrate the body 102 as including the three primary blades 106A, 106C, 106E circumferentially alternating with three secondary blades 106B, 106D, 106F, the body 102 may, alternatively, include a different quantity and/or a different sequence of primary blades and secondary blades.

The cutting elements 114 may comprise a superabrasive (e.g., diamond) mass bonded to a supporting substrate. For example, at least some of the cutting elements 114 may be formed of and include a disc-shaped diamond "table" having a cutting face formed on and bonded under an ultra-high-pressure and high-temperature (HPHT) process to a supporting substrate formed of cemented tungsten carbide. Other known cutting face configurations may also be employed in implementation of embodiments of the disclosure. The cutting elements 114 may be affixed to the blades 106 through brazing, welding, or any other suitable means. The cutting elements 114 may be back raked at a common angle, or at varying angles. In addition, the cutting elements 114 may independently be formed of and include suitably mounted and exposed natural diamonds, thermally stable polycrystalline diamond compacts, cubic boron nitride compacts, tungsten carbide, diamond grit-impregnated segments, or combinations thereof. The material composition of the cutting elements 114 may be selected at least partially based on the hardness and abrasiveness of the subterranean formation to be drilled.

Figure 2A:
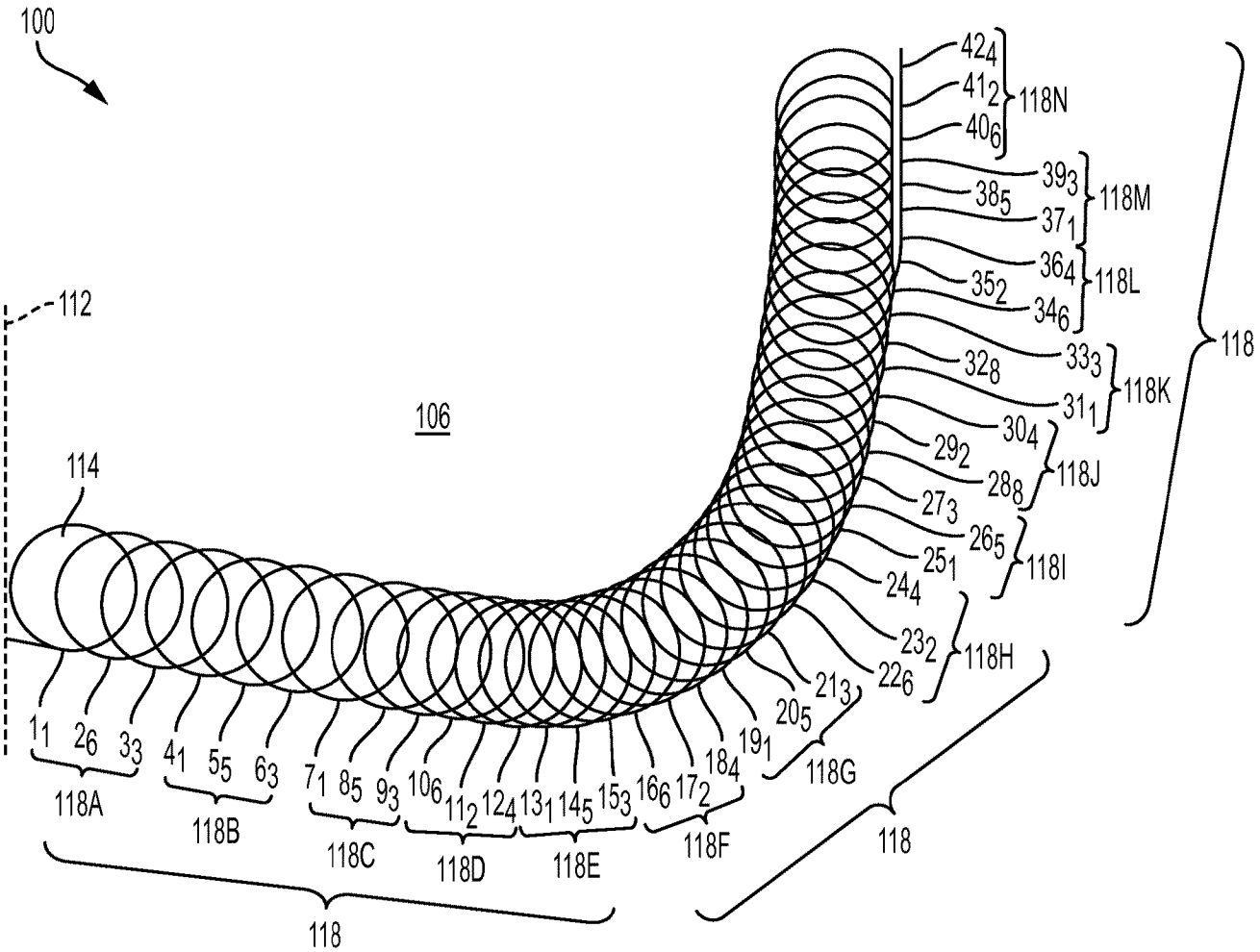
FIG. 2A is a schematic view of the rotary drill bit of FIG. 1 as if each of the cutting elements disposed thereon was rotated onto a single blade.
Figure 2B:
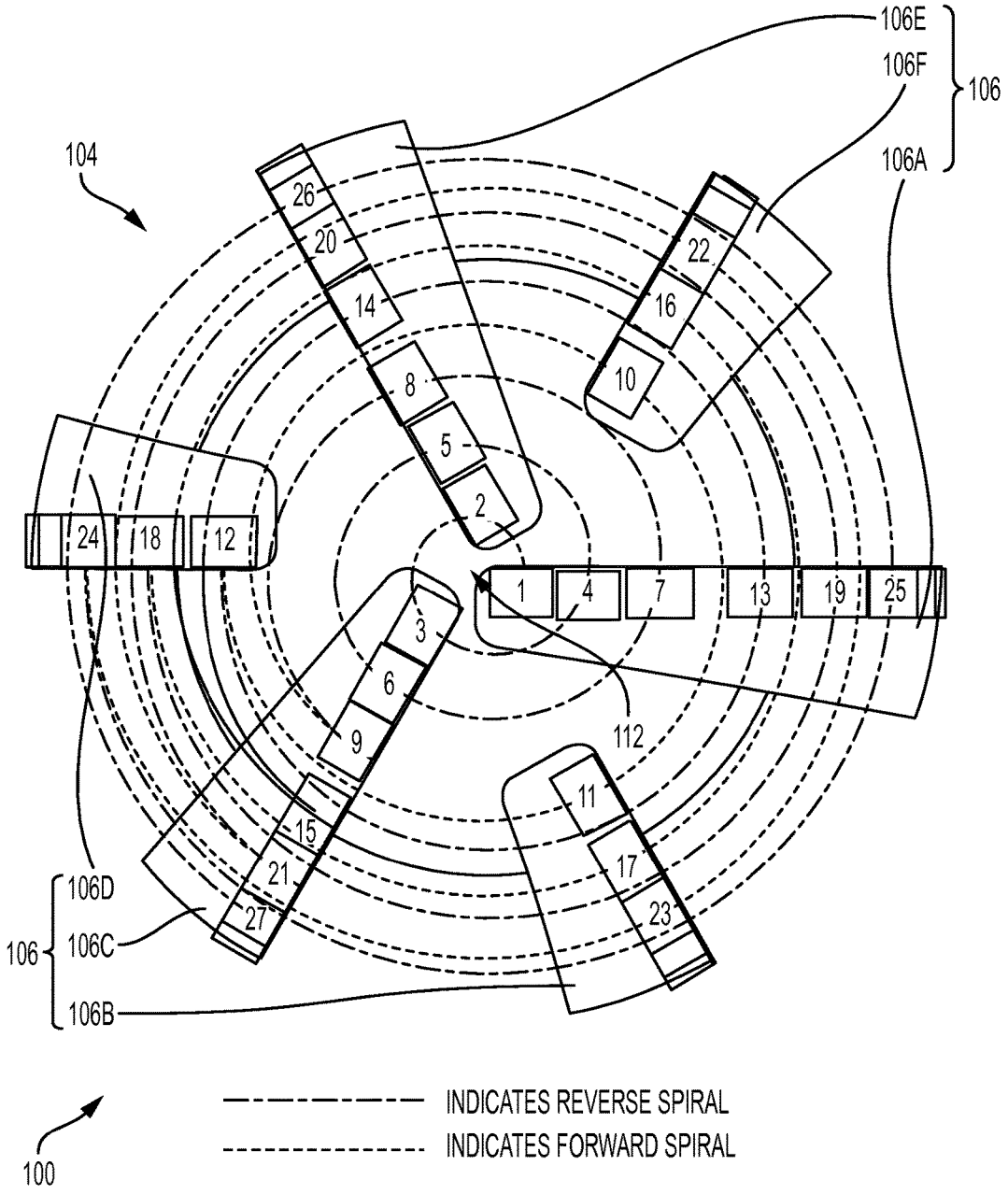
FIG. 2B is a plan view of a face of the rotary drill bit of FIG. 1.

The cutting elements 114 are positioned on the blades 106 to reduce imbalance forces, to more evenly distribute damage (e.g., dulling) across the cutting elements 114, to increase the stability of the rotary drill bit 100, and to extend the life of the rotary drill bit 100 during drilling operations (e.g., drilling of a homogeneous subterranean formation; drilling of a heterogeneous subterranean formation, such as a subterranean formation including transitions between a soft material and a hard material; etc.) as compared to conventional cutting element layouts. FIG. 2A shows a schematic view of a face profile of the rotary drill bit 100 (FIG. 1) as if each of the cutting elements 114 disposed on the various blades 106 was rotated about rotational axis 112 onto a single blade 106. As shown in FIG. 2A, the cutting elements 114 are positioned on the blades 106 and are numbered from 1 to 42 sequentially in the radial direction. The numbering scheme shown correlates to the radial position of the cutting elements 114 with relation to the rotational axis 112 of the rotary drill bit 100. For example, the cutting element 114 identified by the number one (1) is the cutting element 114 closest to the rotational axis 112, while the cutting element 114 identified by the number 42 is positioned farthest from the rotational axis 112. In additional embodiments, the blades 106 may include a different quantity of the cutting elements 114, such as greater than 42 of the cutting elements 114, or less than 42 of the cutting elements 114. Furthermore, in FIG. 2A, the subscript number provided on the number identifying each of the cutting elements 114 correlates to the blade 106 upon which a particular cutting element 114 is located. The subscript number 1 corresponds to the first primary blade 106A, the subscript number 2 corresponds to the first secondary blade 106B, the subscript number 3 corresponds to the second primary blade 106C, the subscript number 4 corresponds to the second secondary blade 106D, the subscript number 5 corresponds to the third primary blade 106E, and the subscript number 6 corresponds to the third secondary blade 106F. For example, "$1_1$" indicates that the cutting element 114 identified by the number 1 is located on the first primary blade 106A, "$2_5$" indicates that the cutting element 114 identified by the number 2 is located on the third primary blade 106E, "$3_3$" indicates that the cutting element 114 identified by the number 3 is located on the second primary blade 106C, "$10_6$" indicates that the cutting element 114 identified by the number 10 is located on the third secondary blade 106F, "$11_2$" indicates that the cutting element 114 identified by the number 11 is located on the first secondary blade 106B, "$12_4$" indicates that the cutting element 114 identified by the number 12 is located on the second secondary blade 106D, etc. FIG. 2B is a plan view of the face 104 of the rotary drill bit 100 showing the position of the cutting elements 114 identified by numbers 1-27 on the blades 106.

Referring collectively to FIGS. 2A and 2B, the cutting elements 114 may be arranged in different groups 118 (FIG. 2A) of neighboring cutting elements. As used herein, "neighboring cutting elements" means and includes cutting elements located radially adjacent to one another on the face profile of a rotary drill bit with less than 100 percent overlap. For example, as depicted in FIG. 2A, in some embodiments, the cutting elements 114 are arranged in fourteen (14) groups 118A-118N each including three (3) neighboring cutting elements. A first group 118A includes the cutting elements 114 identified by the numbers 1, 2, and 3; a second group 118B includes the cutting elements 114 identified by the numbers 4, 5, and 6; a third group 118C includes the cutting elements 114 identified by the numbers 7, 8, and 9; a fourth group 118D includes the cutting elements 114 identified by the numbers 10, 11, 12; a fifth group 118E includes the cutting elements 114 identified by the numbers 13, 14, and 15; a sixth group 118F includes the cutting elements 114 identified by the numbers 16, 17, and 18; and so on. In additional embodiments, such as in embodiments wherein the body 102 (FIG. 1) includes a different quantity of the blades 106 (e.g., a different quantity of primary blades and/or a different quantity of secondary blades) and/or a different quantity of the cutting elements 114, the body 102 may exhibit at least one of a different quantity of the groups 118 of neighboring cutting elements and/or a different quantity of neighboring cutting elements in one or more of the groups 118. For example, the body 102 may exhibit greater than 14 groups of neighboring cutting elements, or less than 14 groups of neighboring cutting elements. As another example, one or more of the groups 118 may include less than three (3) neighboring cutting elements (e.g., two (2) neighboring cutting elements), and/or one or more of the groups 118 may include greater than three (3) neighboring cutting elements (e.g., four (4) neighboring cutting elements). Non-limiting examples of such different arrangements (e.g., groupings) of the cutting elements 114 are described in further detail below. Accordingly, while various embodiments herein describe or illustrate the cutting elements 114 as being arranged in 14 groups each including three (3) neighboring cutting elements, alternatively, the cutting elements 114 may be arranged in a different quantity of groups of neighboring cutting elements and/or one or more of the groups may exhibit a different quantity of neighboring cutting elements.

With continued reference to FIGS. 2A and 2B, different groups 118 (e.g., the first group 118A, the second group 118B, the third group 118C, etc.) of neighboring cutting elements may independently be disposed on and limited to either the primary blades 106A, 106C, 106E or the secondary blades 106B, 106D, 106F. For example, the first three groups (e.g., groups 118A-118C) may each be located only on the primary blades 106A, 106C, 106E, and thereafter the locations of the remaining groups (e.g., groups 118D-118N) may alternate (e.g., switch, change, etc.) between the primary blades 106A, 106C, 106E and the secondary blades 106B, 106D, 106F (e.g., the fourth group 118D may be disposed on only the secondary blades 106B, 106D, 106F; the fifth group 118E may be disposed on only the primary blades 106A, 106C, 106E; the sixth group 118F may be disposed on only the secondary blades 106B, 106D, 106F; and so on). In additional embodiments, such as in embodiments where the body 102 includes a different quantity of the blades 106 (e.g., a different quantity of primary blades and/or a different quantity of secondary blades) an individual group of neighboring cutting elements may exhibit neighboring cutting elements disposed on both primary blades and secondary blades, so long as the neighboring cutting elements of the group are sufficiently circumferentially separated from one another to reduce imbalance forces, evenly distribute damage, increase the drill bit stability, and extend drill bit life during drilling operations as compared to conventional cutting element layouts. Put another way, in additional embodiments, different groups of neighboring cutting elements are not necessarily limited to being located either on primary blades or on secondary blades.

Circumferential separation between neighboring cutting elements within each of the groups 118 may at least partially depend on the quantity of blades 106 (e.g., primary blades and secondary blades) exhibited by the body 102. The circumferential separation between neighboring cutting elements within each of the groups 118 may be maximized within the constraints provided by the quantity of blades 106 exhibited by the body 102 (FIG. 1). The circumferential separation between neighboring cutting elements of a particular group 118 may correspond to the circumferential separation exhibited by the blades 106 (e.g., the primary blades, or the secondary blades) carrying the particular group 118. For example, in embodiments wherein the body 102 includes three (3) primary blades (e.g., the primary blades 106A, 106C, 106E) circumferentially alternating with three (3) secondary blades (e.g., the secondary 106B, 106D, 106F), neighboring cutting elements within each of the groups 118 may be circumferentially separated from one another by an angle within a range of from about 100 degrees to about 140 degrees relative to the rotational axis 112 of the rotary drill bit 100, such as from about 110 degrees to about 130 degrees, from about 115 degrees to about 125 degrees, or about 120 degrees. In additional embodiments, such as in embodiments wherein the body 102 includes a different number of primary blades and/or a different number of secondary blades, the circumferential separation between neighboring cutting elements within a particular group may be a different than from about 100 degrees to about 140 degrees, depending on the quantity of blades (e.g., primary blades, or secondary blades) carrying the particular group. Non-limiting examples of such different circumferential separation of neighboring cutting elements are described in further detail below.

Circumferential separation between the sequentially last cutting element of one of the groups 118 and the sequentially first cutting element of an adjacent one of the groups 118 may also at least partially depend on the quantity of blades 106 (e.g., primary blades and secondary blades) exhibited by the body 102 (FIG. 1). The circumferential separation between sequentially last cutting element of one of the groups 118 and the sequentially first cutting element of an adjacent one of the groups 118 may also be maximized within the constraints provided by the quantity of blades 106 exhibited by the body 102. For example, in the embodiment depicted in FIGS. 2A and 2B, the sequentially last cutting element of each of the first group 118A and the second group 118B may be circumferentially separated from the sequentially first cutting element of an adjacent group (e.g., the second group 118B for the first group 118A, the third group 118C for the second group 118B) by an angle within a range of from about 100 degrees to about 140 degrees relative to the rotational axis 112 of the rotary drill bit 100, such as from about 110 degrees to about 130 degrees, from about 115 degrees to about 125 degrees, or about 120 degrees. After the second group 118B, the sequentially last cutting element of each of the remaining groups (e.g., groups 118C-118N) may be circumferentially separated from the sequentially first cutting element of an adjacent group (e.g., the fourth group 118D for the third group 118C, the fifth group 118E for the fourth group 118D, etc.) by an angle within a range of from about 160 degrees to about 200 degrees relative to the rotational axis 112 of the rotary drill bit 100, such as from about 170 degrees to about 190 degrees, from about 175 degrees to about 185 degrees, or about 180 degrees. By way of non-limiting example, the cutting element 114 identified by the number 6 of the second group 118B may be circumferentially separated from the cutting element 114 identified by the number 7 of the third group 118C by from about 100 degrees to about 140 degrees; the cutting element 114 identified by the number 9 of the third group 118C may be circumferentially separated from the cutting element 114 identified by the number 10 of the fourth group 118D by from about 160 degrees to about 200 degrees; etc. In additional embodiments, such as in embodiments wherein the body 102 includes a different number of primary blades and/or a different number of secondary blades, the circumferential separation between the sequentially last cutting element of a particular group and the sequentially first cutting element of an adjacent group may be different than within a range of from about 100 degrees to about 140 degrees or within a range of from about 160 degrees to about 200 degrees. Non-limiting examples of such different circumferential separation between the sequentially last cutting element of a particular group and the sequentially first cutting element of an adjacent group are described in further detail below.

With continued reference to FIGS. 2A and 2B, some of the groups 118 (FIG. 2A) may be provided on the blades 106 in reverse spiral configurations (i.e., identified in FIG. 2B by dashed lines), and others of the groups 118 may be provided on the blades 106 in forward spiral configurations (i.e., identified in FIG. 2B by dotted lines). As used herein, the term "reverse spiral configuration" means and includes a configuration wherein neighboring cutting elements are positioned on an earth-boring tool (e.g., a rotary drill bit) so as to form an arcuate (e.g., curved) path extending from a cutting element more radially proximate a rotational axis of the earth-boring tool to another cutting element more radially distal from the rotational axis in the rotational direction of the earth-boring tool. For example, a first cutting element may be positioned on a first of the blades 106, and a second cutting element radially adjacent the first cutting element, but radially distal from the rotational axis 112 of the rotary drill bit 100 relative to the first cutting element, may be positioned on a second of the blades 106 that rotationally leads the first of the blades 106. Conversely, as used herein, the term "forward spiral configuration" means and includes a configuration wherein neighboring cutting elements are positioned on an earth-boring tool (e.g., a rotary drill bit) so as to form an arcuate path extending from a cutting element more radially proximate a rotational axis of the earth-boring tool bit to another cutting element more radially distal from the rotational axis in a direction opposite (e.g., against) the rotational direction of the earth-boring tool. For example, a first cutting element may be positioned on a first of the blades 106, and a second cutting element radially adjacent the first cutting element, but radially distal from the rotational axis 112 of the rotary drill bit 100 relative to the first cutting element, may be positioned on a second of the blades 106 that rotationally trails the first of the blades 106.

As shown in FIG. 2B, in some embodiments, groups of neighboring cutting elements positioned on primary blades (e.g., the primary blades 106A, 106C, 106E) each exhibit a reverse spiral configuration, and groups of neighboring cutting elements positioned on secondary blades (e.g., the secondary blades 106B, 106D, 106F) each exhibit a forward spiral configuration. By way of non-limiting example, the cutting elements 114 of the first group 118A, the second group 118B, and the third group 118C (e.g., the cutting elements identified by the numbers 1-9) may be sequentially positioned on the primary blades 106A, 106C, 106E in a reverse spiral configuration (e.g., number 1 positioned on blade 106A, number 2 positioned on blade 106E, number 3 positioned on blade 106C, number 4 positioned on blade 106A, and so on); the cutting elements 114 of the fourth group 118D (e.g., the cutting elements 114 identified by the numbers 10-12) may be sequentially positioned on the secondary blades 106B, 106D, 106F in a forward spiral configuration (e.g., number 10 positioned on blade 106F, number 11 positioned on blade 106B, number 12 positioned on blade 106D); the cutting elements 114 of the fifth group 118E (e.g., the cutting elements identified by the numbers 13-15) may be sequentially positioned on the primary blades 106A, 106C, 106E in a reverse spiral configuration (e.g., number 13 positioned on blade 106A, number 14 positioned on blade 106E, number 15 positioned on blade 106C); and so on. In additional embodiments, the spiral configurations may be reversed, such that groups of neighboring cutting elements positioned on primary blades (e.g., the primary blades 106A, 106C, 106E) each exhibit a forward spiral configuration, and groups of neighboring cutting elements positioned on secondary blades (e.g., the secondary blades 106B, 106D, 106F) each exhibit a reverse spiral configuration.

For at least some of the groups 118, the sequentially last cutting element prior to a change in spiral configuration may exhibit one spiral configuration (e.g., a reverse spiral configuration, or a forward spiral configuration) with at least one sequentially preceding (e.g., radially preceding) cutting element, such as cutting elements of the same group, and may exhibit an opposing spiral configuration with at least one sequentially subsequent (e.g., radially subsequent) cutting element, such as cutting elements of an immediately subsequent group. By way of non-limiting example, the cutting element 114 identified by the number 9 may be in a reverse spiral configuration with the cutting elements 114 identified by the numbers 1-8, and may be in a forward spiral configuration with the cutting elements 114 identified by the numbers 10-12; the cutting element 114 identified by the number 12 may be in a forward spiral configuration with the cutting elements 114 identified by the numbers 10 and 11, and may be in a reverse spiral configuration with the cutting elements 114 identified by the numbers 13-15; the cutting element 114 identified by the number 15 may be in a reverse spiral configuration with the cutting elements 114 identified by the numbers 13 and 14, and may be in a forward spiral configuration with the cutting elements 114 identified by the numbers 16-18; the cutting element 114 identified by the number 18 may be in a forward spiral configuration with the cutting elements 114 identified by the numbers 16 and 17, and may be in a reverse spiral configuration with the cutting elements 114 identified by the numbers 19-21; and so on.

In some embodiments, a transition between at least one of the groups 118 exhibiting a reverse spiral configuration and at least one other of the groups 118 exhibiting a forward spiral configuration is disposed in a nose region of the face 104 of the rotary drill bit 100 (FIG. 1), such that at least some of the cutting elements 114 are in a reverse spiral configuration in the nose region and at least some other of the cutting elements 114 are in a forward spiral configuration in the nose region. As a non-limiting example, as shown in FIGS. 2A and 2B, the transition between the third group 118C, which exhibits a reverse spiral configuration, and the fourth group 118D, which exhibits a forward spiral configuration, may be disposed in the nose region of the face 104 of the rotary drill bit 100, such that at least the cutting elements 114 identified by the numbers 8 and 9 are in a reverse spiral configuration in the nose region and at least the cutting elements 114 identified by the numbers 10-12 are in a forward spiral configuration in the nose region.

The cutting elements 114 of each of the groups 118 may exhibit substantially the same characteristics (e.g., sizes, shapes, chamfers, rakes, exposures, diamond grades, diamond abrasion resistance properties, impact resistance properties, etc.) as the cutting elements 114 within each other of the groups 118, or one or more of the cutting elements 114 of at least one of the groups 118 may exhibit at least one different characteristic (e.g., a different size, a different shape, a different chamfer, a different rake, a different exposure, a different diamond grade, a different diamond abrasion resistance property, a different impact resistance property, etc.) than one or more of the cutting elements 114 of at least one other of the groups 118. As a non-limiting example, at least a portion of the cutting elements 114 (e.g., the cutting elements identified by the numbers 1-6) located within a cone region of the face 104 of the rotary drill bit 100 may exhibit a different size (e.g., a smaller size, such as a smaller cutting face size) than at least a portion of the cutting elements 114 (e.g., the cutting elements 114 identified by the numbers 7-42) in at least one of a nose region, a shoulder region, and a gage region of the face 104 of the rotary drill bit 100. The sizes of the cutting elements 114 (e.g., the cutting elements 114 identified by the numbers 1-42) may, for example, be independently selected to tailor (e.g., control) the work rates of the cutting elements 114 at different radial positions.

In addition, as shown in FIG. 1, one or more of the blades 106 may, optionally, include at least one row of backup cutting elements 120. If present, the backup cutting elements 120 may be provided on the blades 106 rotationally behind the cutting elements 114. The backup cutting elements 120 may be redundant with the cutting elements 114. Put another way, the backup cutting elements 120 may be located at substantially the same longitudinal and radial positions on the face profile (see FIG. 2A) as the cutting elements 114 rotationally leading the backup cutting elements 120, such that the backup cutting elements 120 at least substantially follow the cutting paths of the cutting elements 114 (e.g., the backup cutting element 120 located rotationally behind the cutting element 114 identified by the number 14 on the primary blade 106E may at least substantially follow the cutting path of the cutting element 114 identified by the number 14, etc.). If present, each of the backup cutting elements 120 may exhibit substantially the same characteristics (e.g., sizes, shapes, chamfers, rakes, exposures, diamond grades, diamond abrasion resistance properties, impact resistance properties, etc.), or one or more of the backup cutting elements 120 may exhibit at least one different characteristic (e.g., a different size, a different shape, a different chamfer, a different rake, a different exposure, a different diamond grade, a different diamond abrasion resistance property, a different impact resistance property, etc.) than one or more of other of the backup cutting elements 120.

As previously described, in additional embodiments the body 102 may exhibit at least one of a different quantity of the blades 106, a different quantity of primary blades, a different quantity of secondary blades, a different quantity of the cutting elements 114, a different quantity of the groups 118, and/or a different quantity of neighboring cutting elements in one or more of the groups 118. By way of non-limiting example, FIGS. 3A through 4B illustrate schematic (e.g., FIGS. 3A and 4A) and plan (FIGS. 3B and 4B) views similar to those illustrated in FIGS. 2A and 2B, respectively, for rotary drill bits in accordance with additional embodiments of the disclosure. To avoid repetition, not all features shown in FIGS. 3A through 4B are described in detail herein. Rather, unless described otherwise below, features shown in FIGS. 3A through 4B and designated by a reference numeral that is a 100 increment of the reference numeral of a feature described previously will be understood to be substantially similar to the feature described previously.

Figure 3A:
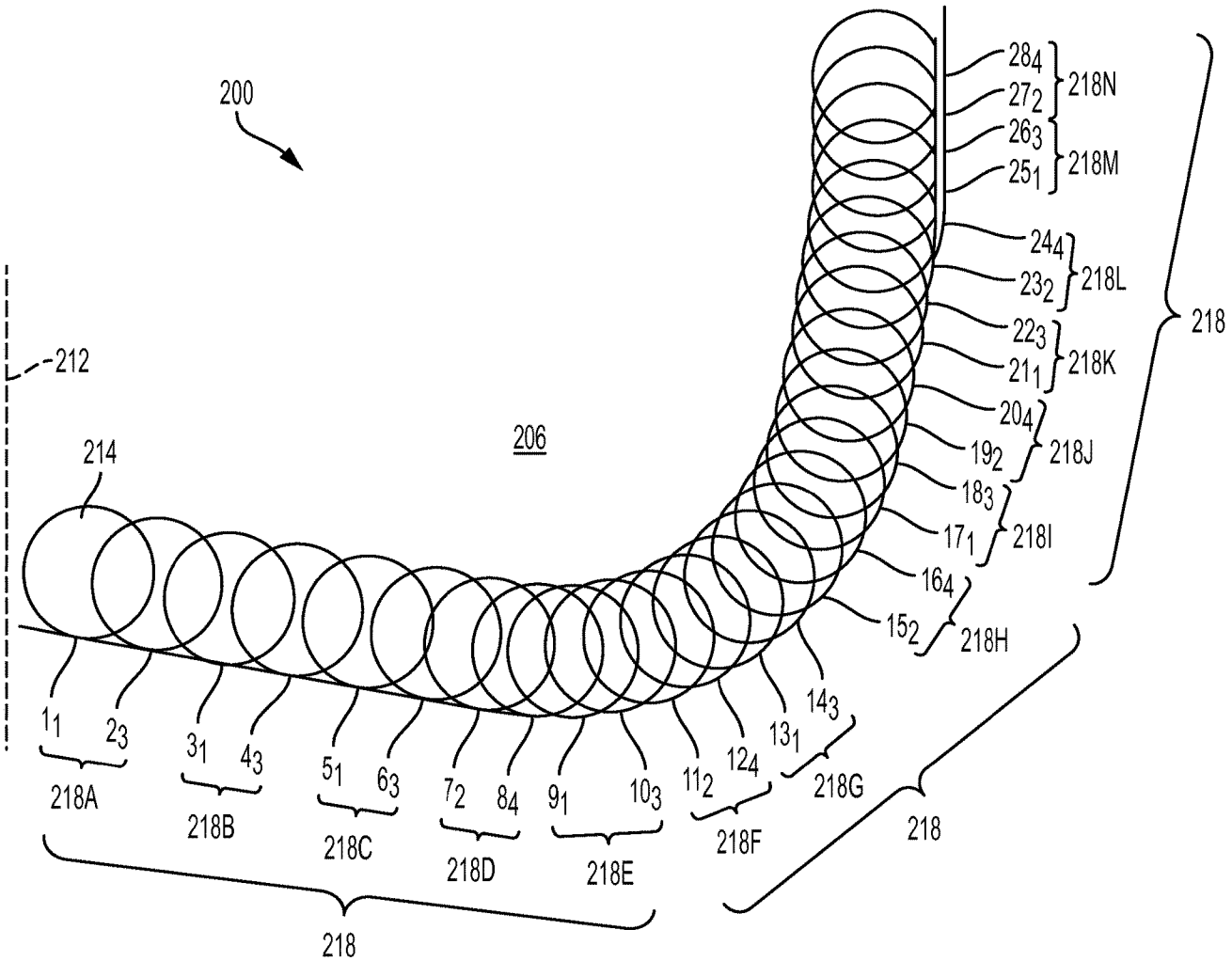
FIG. 3A is a schematic view of a rotary drill as if each of the cutting elements disposed thereon was rotated onto a single blade, in accordance with another embodiment of the disclosure.
Figure 3B:
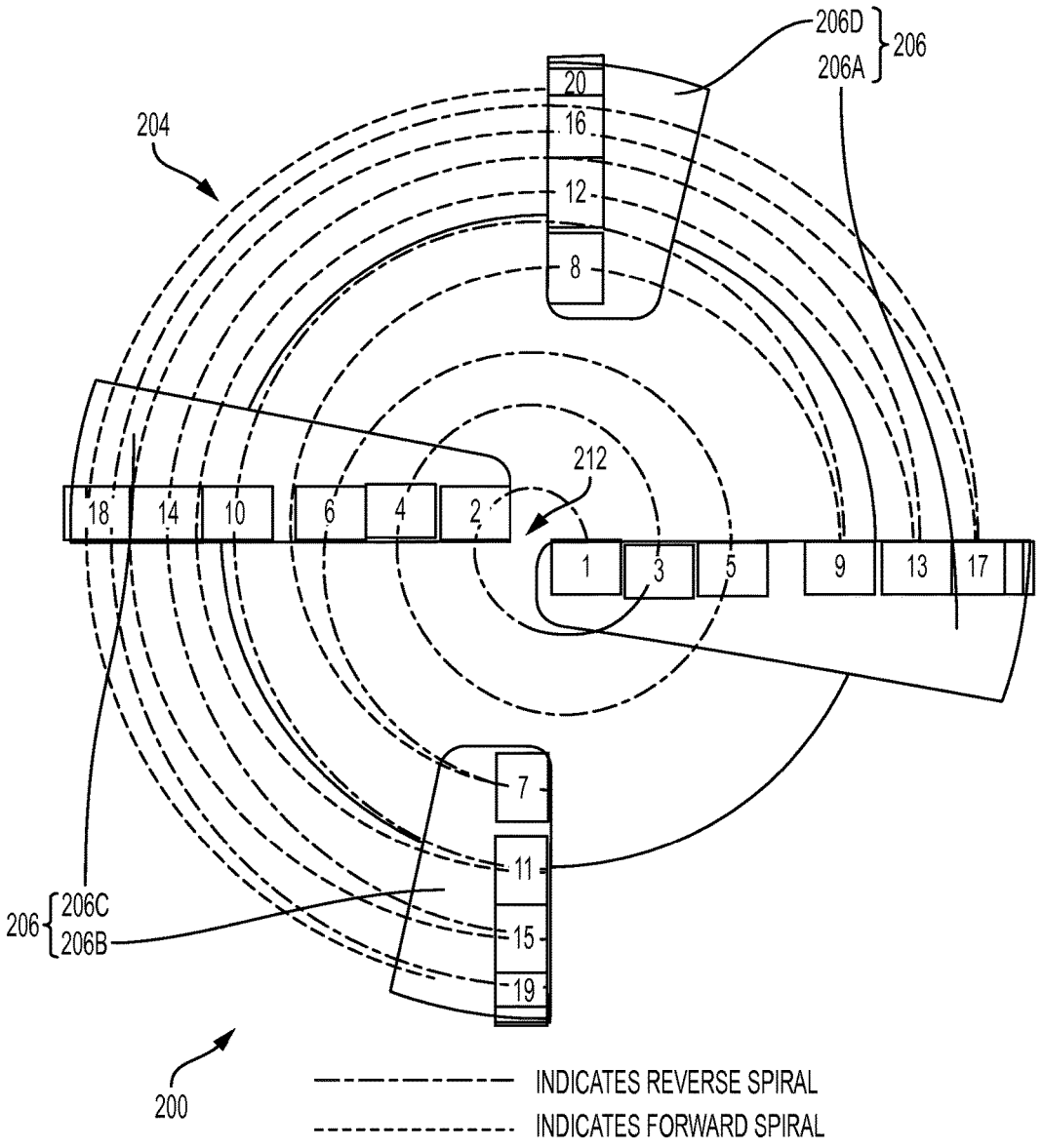
FIG. 3B is a plan view of a face of the rotary drill bit of FIG. 3A.

Referring first to FIGS. 3A and 3B, collectively, a rotary drill bit 200 according to an additional embodiment of the disclosure may exhibit four (4) blades 206 (FIG. 3B), including two (2) primary blades 206A, 206C (FIG. 3B) circumferentially alternating with two (2) secondary blades 206B, 206D (FIG. 3B). A first primary blade 206A may be circumferentially separated from a second primary blade 206C by a first secondary blade 206B, and the second primary blade 206C may also be circumferentially separated from the first primary blade 206A by a second secondary blade 206D. As shown in FIG. 3A, cutting elements 214 numbered from 1 to 28 sequentially in the radial direction relative to a rotational axis 212 of the rotary drill bit 200 may be positioned on or over the blades 206. Similar to FIG. 2A, in FIG. 3A the subscript number provided on the number identifying each of the cutting elements 214 correlates to the blade 206 upon which a particular cutting element 214 is located. The subscript number 1 corresponds to the first primary blade 206A, the subscript number 2 corresponds to the first secondary blade 206B, the subscript number 3 corresponds to the second primary blade 206C, and the subscript number 4 corresponds to the second secondary blade 206D.

As depicted in FIG. 3A, the cutting elements 214 may be arranged in different groups 218 (e.g., groups 218A-218N) each independently including two (2) neighboring cutting elements. Different groups 218 of neighboring cutting elements may independently be disposed on and limited to either the primary blades 206A, 206C or the secondary blades 206B, 206D. Groups of neighboring cutting elements positioned on the primary blades 106A, 106C each exhibit a different spiral configuration than groups of neighboring cutting elements positioned on the secondary blades 106B, 106D. For example, as shown in FIG. 3B, groups of neighboring cutting elements positioned on the primary blades 106A, 106C may each exhibit a reverse spiral configuration, and groups of neighboring cutting elements positioned on the secondary blades 106B, 106D may each exhibit a forward spiral configuration.

Neighboring cutting elements within each of the groups 218 may be circumferentially separated from one another by an angle within a range of from about 160 degrees to about 200 degrees (e.g., from about 170 degrees to about 190 degrees, from about 175 degrees to about 185 degrees, or about 180 degrees) relative to the rotational axis 212 of the rotary drill bit 200. The sequentially last cutting element of each of the first group 218A and the second group 218B may be circumferentially separated from the sequentially first cutting element of an adjacent group (e.g., the second group 218B for the first group 218A, the third group 218C for the second group 218B) by an angle within a range of from about 160 degrees to about 200 degrees (e.g., such as from about 170 degrees to about 190 degrees, from about 175 degrees to about 185 degrees, or about 180 degrees) relative to the rotational axis 212 of the rotary drill bit 200. After the second group 218B, the sequentially last cutting element of each of the remaining groups (e.g., groups 218C-218N) may be circumferentially separated from the sequentially first cutting element of an adjacent group (e.g., the fourth group 218D for the third group 218C, the fifth group 218E for the fourth group 218D, etc.) by an angle within a range of from about 70 degrees to about 110 degrees (e.g., from about 80 degrees to about 100 degrees, from about 85 degrees to about 95 degrees, or about 90 degrees) relative to the rotational axis 212 of the rotary drill bit 200.

Figure 4A:
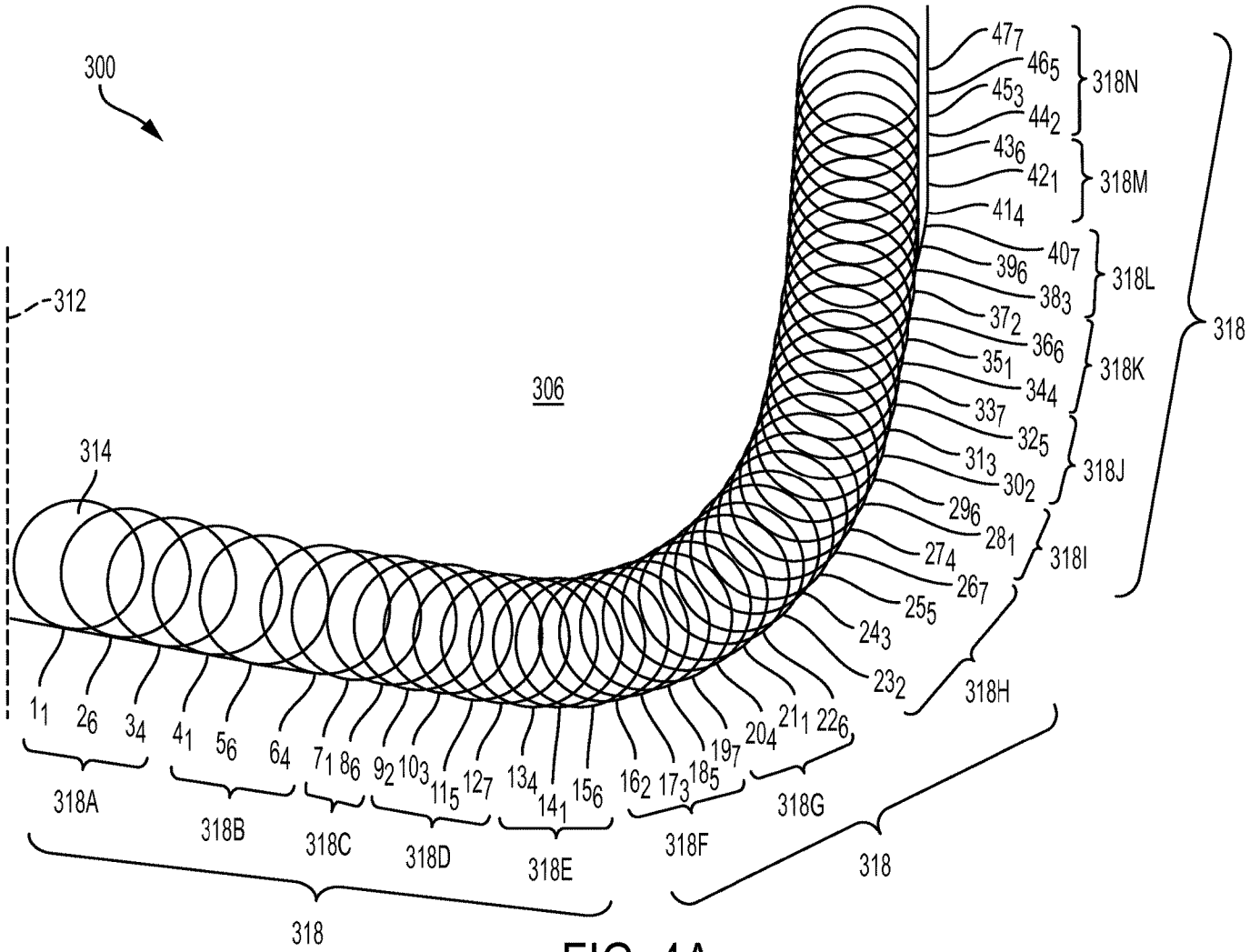
FIG. 4A is a schematic view of a rotary drill as if each of the cutting elements disposed thereon was rotated onto a single blade, in accordance with another embodiment of the disclosure.
Figure 4B:
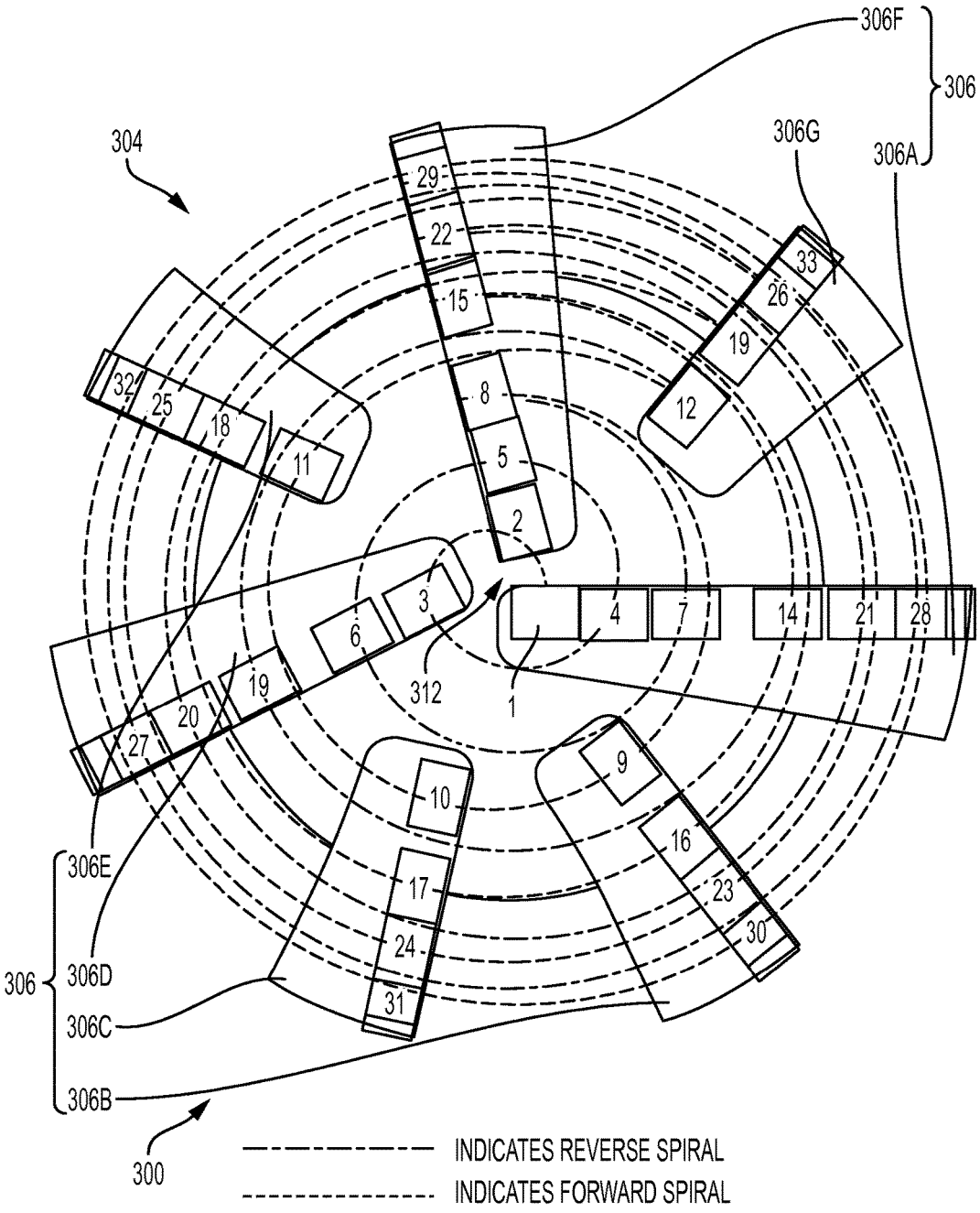
FIG. 4B is a plan view of a face of the rotary drill bit of FIG. 4A.

Referring next to FIGS. 4A and 4B, collectively, a rotary drill bit 300 according to an additional embodiment of the disclosure may exhibit seven (7) blades 306 (FIG. 4B), including three (3) primary blades 306A, 306D, 306F (FIG. 4B) partially circumferentially alternating with four (4) secondary blades 306B, 306C, 306E, 306G (FIG. 4B). A first primary blade 306A may be circumferentially separated from a second primary blade 306D by each of a first secondary blade 306B and a second secondary blade 306C, the second primary blade 306D may be circumferentially separated from a third primary blade 306F by a third secondary blade 306E, and the third primary blade 306F may be circumferentially separated from the first primary blade 306A by a fourth secondary blade 306G. As shown in FIG. 3A, cutting elements 314 numbered from 1 to 47 sequentially in the radial direction relative to a rotational axis 312 of the rotary drill bit 300 may be positioned on or over the blades 306. Similar to FIG. 2A, in FIG. 4A the subscript number provided on the number identifying each of the cutting elements 314 correlates to the blade 306 upon which a particular cutting element 314 is located. The subscript number 1 corresponds to the first primary blade 306A, the subscript number 2 corresponds to the first secondary blade 306B, the subscript number 3 corresponds to the second secondary blade 306C, the subscript number 4 corresponds to the second primary blade 306D, the subscript number 5 corresponds to the third secondary blade 306E, the subscript number 6 corresponds to the third primary blade 306F, and the subscript number 7 corresponds to the fourth secondary blade 306G.

As depicted in FIG. 4A, the cutting elements 314 may be arranged in different groups 318 (e.g., groups 318A-318N) each independently including two (2), three (3), or four (4) neighboring cutting elements. For example, a first group 318A may include three (3) neighboring cutting elements (e.g., numbers 1-3), a second group 318B may include three (3) neighboring cutting elements (e.g., numbers 4-6), a third group 318C may include two (2) neighboring cutting elements (e.g., 7 and 8), a fourth group 318D may include four (4) neighboring cutting elements (e.g., numbers 9-12), a fifth group 318E may include three (3) neighboring cutting elements (e.g., numbers 13-15), a sixth group 318F may include four (4) neighboring cutting elements (e.g., numbers 16-19), etc. Different groups 218 of neighboring cutting elements may independently be disposed on and limited to either the primary blades 306A, 306D, 306F or the secondary blades 306B, 306C, 306E, 306G. Groups of neighboring cutting elements positioned on the primary blades 306A, 306D, 306F each exhibit a different spiral configuration than groups of neighboring cutting elements positioned on the secondary 306B, 306C, 306E, 306G. For example, as shown in FIG. 4B, groups of neighboring cutting elements positioned on the primary blades 306A, 306D, 306F may each exhibit a reverse spiral configuration, and groups of neighboring cutting elements positioned on the secondary blades 306B, 306C, 306E, 306G may each exhibit a forward spiral configuration.

Neighboring cutting elements within each of the groups 318 disposed on and limited to the primary blades 306A, 306D, 306F may be circumferentially separated from one another by an angle within a range of from about 100 degrees to about 140 degrees (e.g., from about 110 degrees to about 130 degrees, from about 115 degrees to about 125 degrees, or about 120 degrees) relative to the rotational axis 312 of the rotary drill bit 300. In addition, neighboring cutting elements within each of the groups 318 disposed on and limited to the secondary blades 306B, 306C, 306E, 306G may be circumferentially separated from one another by an angle within a range of from about 60 degrees to about 120 degrees (e.g., from about 70 degrees to about 110 degrees, from about 80 degrees to about 100 degrees, or about 90 degrees) relative to the rotational axis 312 of the rotary drill bit 300. The sequentially last cutting element of each of the first group 318A and the second group 318B may be circumferentially separated from the sequentially first cutting element of an adjacent group (e.g., the second group 318B for the first group 318A, the third group 318C for the second group 318B) by an angle within a range of from about 100 degrees to about 140 degrees (e.g., such as from about 110 degrees to about 130 degrees, from about 125 degrees to about 125 degrees, or about 120 degrees) relative to the rotational axis 312 of the rotary drill bit 300. After the second group 318B, the sequentially last cutting element of each of the remaining groups (e.g., groups 318C-318N) may be circumferentially separated from the sequentially first cutting element of an adjacent group (e.g., the fourth group 318D for the third group 318C, the fifth group 318E for the fourth group 318D, etc.) by an angle within a range of from about 160 degrees to about 200 degrees (e.g., from about 170 degrees to about 190 degrees, from about 175 degrees to about 185 degrees, or about 180 degrees) relative to the rotational axis 312 of the rotary drill bit 300.

In operation, a rotary drill bit, according to an embodiment of the disclosure, (e.g., the rotary drill bit 100, 200, 300) may be rotated about its rotational axis (e.g., the rotational axis 112, 212, 312) in a borehole extending into a subterranean formation. As the rotary drill bit rotates, at least some of the cutting elements thereof (e.g., at least some of the cutting elements 114, 214, 314) provided in rotationally leading positions across the body of the rotary drill bit may engage surfaces of the borehole and remove (e.g., shear, cut, gouge, etc.) portions of the subterranean formation, forming grooves in the subterranean formation. The cutting elements provided in rotationally trailing positions may then follow and enlarge the grooves formed by the rotationally leading cutting elements.

The layouts of the cutting elements (e.g., the cutting elements 114, 214, 314), described herein, may more evenly distribute forces on neighboring cutting elements during drilling operations, reducing disparities in cutting element damage (e.g., dulling), increasing drill bit stability, and prolonging drill bit life as compared to conventional cutting element layouts. For example, the maximizing the circumferential separation between neighboring cutting elements within each of the groups (e.g., each of the groups 118, 218, 318) and also maximizing the circumferential separation between the last cutting element of a group in one spiral configuration (e.g., reverse spiral configuration, forward spiral configuration) from the first cutting element of an adjacent group in an opposing spiral configuration may more evenly distribute forces (e.g., loads) across the blades (e.g., the blades 106, 206, 306) of a rotary drill bit (e.g., the rotary drill bit 100, 200, 300) relative to conventional cutting element layouts, substantially mitigating preferential loading of one group of the blades over another group of the blades that may otherwise destabilize (e.g., imbalance) the rotary drill bit and produce progressively greater (and, hence, uneven) damage in rotationally trailing cutting elements on the body of the rotary drill bit.

While certain embodiments have been described and shown in the accompanying drawings, such embodiments are merely illustrative and not restrictive of the scope of the disclosure, and this disclosure is not limited to the specific constructions and arrangements shown and described, since various other additions and modifications to, and deletions from, the described embodiments will be apparent to one of ordinary skill in the art. The scope of the invention, as exemplified by the various embodiments of the present disclosure, is limited only by the claims which follow, and their legal equivalents.

What is claimed is:

1. An earth-boring tool, comprising:

a body having a face at a leading end thereof;

blades extending from the body and comprising primary blades and secondary blades; and cutting elements on the blades and arranged in groups each comprising neighboring cutting elements sequentially positioned directly radially adjacent one another across the face of the body, wherein:

all of the cutting elements disposed on the primary blades belong to groups exhibiting a first spiral configuration; and all of the cutting elements disposed on the secondary blades belong to additional groups exhibiting a second spiral configuration opposing the first spiral configuration.

2. The earth-boring tool of claim 1, wherein the blades comprise an even quantity of the primary blades and an even quantity of the secondary blades.

3. The earth-boring tool of claim 1, wherein the blades comprise an even quantity of one of the primary blades and the secondary blades, and an odd quantity of the other of the primary blades and the secondary blades.

4. The earth-boring tool of claim 1, wherein the blades comprise three of the primary blades and three of the secondary blades.

5. The earth-boring tool of claim 4, wherein each of the groups comprises three neighboring cutting elements.

6. The earth-boring tool of claim 5, wherein the three neighboring cutting elements of each of the groups are circumferentially separated from one another by an angle within a range of from 100 degrees to 140 degrees relative to a rotational axis of the earth-boring tool.

7. The earth-boring tool of claim 4, wherein a sequentially last cutting element of at least one of the groups is circumferentially separated from a sequentially first cutting element of a subsequent, adjacent group by an angle within a range of from 160 degrees to 200 degrees relative to a rotational axis of the earth-boring tool.

8. The earth-boring tool of claim 4, wherein a sequentially first cutting element of at least one of the groups is circumferentially separated from a sequentially last cutting element of a preceding, adjacent group by an angle between 180 degrees and 190 degrees relative to a rotational axis of the earth-boring tool.

9. The earth-boring tool of claim 1, wherein all of the groups disposed on the primary blades exhibit a reverse spiral configuration, and wherein all of the groups disposed on the secondary blades exhibit a forward spiral configuration.

10. The earth-boring tool of claim 1, wherein at least one of the cutting elements exhibits at least one of a different size, a different shape, a different chamfer, a different rake, a different exposure, a different diamond grade, a different diamond abrasion resistance property, and a different impact resistance property than at least one other of the cutting elements.

11. The earth-boring tool of claim 1, wherein the cutting elements of a first of the groups proximate a rotational axis of the earth-boring tool and a second of the groups radially adjacent the first of the groups each exhibit a smaller size than the cutting elements of radially subsequent groups.

12. The earth-boring tool of claim 1, further comprising backup cutting elements rotationally behind and at substantially the same radial positions as at least some of the cutting elements on the blades.

13. A method of forming an earth-boring tool, comprising:

forming a body comprising a face at a leading end thereof, blades extending from the body and comprising primary blades and secondary blades; and disposing cutting elements on the blades in groups each comprising neighboring cutting elements sequentially positioned directly radially adjacent one another across the face of the body, wherein:

all of the cutting elements disposed on the primary blades belong to groups exhibiting a first spiral configuration; and all of the cutting elements disposed on the secondary blades belong to additional groups exhibiting a second spiral configuration opposing the first spiral configuration.

14. The method of claim 13, wherein forming a body comprises forming the blades to comprise an even quantity of the primary blades and an even quantity of the secondary blades.

15. The method of claim 13, wherein forming a body comprises forming the blades to comprise an even quantity of one of the primary blades and the secondary blades, and an odd quantity of the other of the primary blades and the secondary blades.

16. The method of claim 13, wherein forming a body comprises forming the primary blades to circumferentially alternate with the secondary blades.

17. The method of claim 13, wherein disposing cutting elements on the blades in groups comprises:

forming a first three of the groups radially proximate a rotational axis of the earth-boring tool to each exhibit a reverse spiral configuration; and forming additional groups radially subsequent to the first three of the groups to alternate with one another between forward spiral configurations and reverse spiral configurations.

18. The method of claim 13, wherein disposing cutting elements on the blades in groups comprises forming at least some of the groups to comprise three of the neighboring cutting elements circumferentially separated from one another by an angle within a range of from 100 degrees to 140 degrees relative to a rotational axis of the earth-boring tool.

19. A method of forming a borehole in a subterranean formation, comprising:

disposing an earth-boring tool at a distal end of a drill string in a borehole in a subterranean formation, the earth-boring tool comprising:

a body having a face at a leading end thereof;

blades extending from the body and comprising primary blades and secondary blades; and cutting elements on the blades and arranged in groups each comprising neighboring cutting elements sequentially positioned directly radially adjacent one another across the face of the body, wherein:

all of the cutting elements disposed on the primary blades belong to groups exhibiting a first spiral configuration; and all of the cutting elements disposed on the secondary blades belong to additional groups exhibiting a second spiral configuration opposing the first spiral configuration;

applying weight on bit to the earth-boring tool through the drill string to contact the subterranean formation while rotating the earth-boring tool; and engaging the subterranean formation with the cutting elements of the rotating earth-boring tool.

* * * * *